United States Patent [19]

Voronin et al.

[11] Patent Number: 4,931,702

[45] Date of Patent: Jun. 5, 1990

[54] ELECTRIC-ARC DEVICE

[75] Inventors: Alexandr V. Voronin; Vladimir M. Kuznetsov; Boris P. Peregud; Alexandr I. Rusakov, all of Leningrad, U.S.S.R.

[73] Assignee: Fiziko-Tekhnichesky Institut Imeni A.F. Ioffe an SSSR, Leningrad, U.S.S.R.

[21] Appl. No.: 206,046

[22] Filed: Jun. 13, 1988

[51] Int. Cl.[5] ..... H05B 41/00; H01J 1/50

[52] U.S. Cl. ..... 315/344; 313/153; 373/107

[58] Field of Search ..... 315/111.01, 111.11, 315/111.41, 111.61, 111.81, 344, 346, 348, 326; 373/62, 63, 64, 107; 313/231.41, 231.51, 153, 154, 160, 161, 162; 427/47

[56] References Cited

U.S. PATENT DOCUMENTS

| | | | |
|---|---|---|---|
| 2,978,525 | 4/1961 | Gruber et al. | 373/107 |
| 3,636,228 | 1/1972 | Comenetz | 373/107 |
| 3,793,468 | 2/1974 | Akers | 373/107 |
| 4,829,215 | 5/1989 | Kim et al. | 315/344 X |
| 4,859,908 | 8/1989 | Yoshida et al. | 315/111.81 |

FOREIGN PATENT DOCUMENTS 1267633 of 0000 U.S.S.R. .

OTHER PUBLICATIONS

Pasternak, A. W. et al., "Probe and Spectroscopic Measurements In A High-Density DC Argon Arc Plasma"; *Journal of Applied Physics,* vol. 46, No. 3, Mar. 1975, pp. 1135–1140.

*Primary Examiner*—David Mis
*Attorney, Agent, or Firm*—Lilling & Greenspan

[57] ABSTRACT

An electric-arc device has two aligned electrodes separated by an arc gap. The position of an electric arc in the arc gap is stabilized by using at least two coils, each made as a rectangular loop and bent around a cylindric surface. The coils are mounted around the electrodes such that their arcuate sides form two respective circumferences whose centers lie on a line parallel to the axis of the electrodes. The length of the straight side of each coil is no less than the length of the arc gap. The coils are connected to a power supply such that currents flowing along the adjacent straight sides of the neighboring coils are oppositely directed. These opposing currents induce a magnetic field into the arc gap which controls the location of the electric arc. The location of each coil with respect to a plane passing through the middle of the arc gap normal to the axis of the electrodes is limited by two extreme positions, in the first of which the coil is symmetric about said plane, and in the second the coil is displaced towards the negative electrode and one of the arcuate sides thereof lies in this plane. In another embodiment of the device the means for stabilizing the position of an electric arc in the arc gap is formed by two cylindrical coils embracing the electrodes.

1 Claim, 2 Drawing Sheets

ELECTRIC-ARC DEVICE

BACKGROUND OF THE INVENTION

1. Field of the Invention

The present invention relates to the art of electrical engineering, and more particularly to electric-arc devices. It can be applied in metallurgy for heat treatment for conductors, such as for welding and melting of metals in vacuum electric-arc furnaces and for deposition of metals by spraying.

2. Description of the Prior Art

In heat treatment of metals in vacuum electric-arc furnaces it is advisable in some cases to stabilize the position of an electric arc in the arc gap between electrodes in order to prevent the arc from getting onto the side walls of the electrodes and onto the wall of the vacuum chamber, which may result in burning through the walls of the chamber and even in an explosion. Stabilization of the arc position in the arc gap is also required in welding to provide a high quality of welding of electrodes as well as in melting of metal in skull electric-arc furnaces.

Known in the prior art is an electric-arc device (U.S. Pat. No. 2,978,525) comprising two alignment electrodes separated by an arc gap and a solenoid embracing the electrodes and mounted coaxially therewith. A uniform magnetic field produced by the solenoid in the arc gap confines the electric arc to the zone of the arc gap thus preventing it from getting onto the side walls of the electrodes and vacuum chamber. However, there is no stabilization of the arc position in the arc gap, and the arc moves between the electrodes at random.

Also known in the prior art is an electric-arc device (U.S. Pat. No. 3,636,228) comprising two aligned electrodes separated by an arc gap and a coil coaxially with the electrodes inside the negative electrode close to its working surface. In this device the electric arc under the influence of a nonuniform magnetic field produced by the coil travels over the periphery of the working surface of the negative electrode, and thus stabilization of the arc position in the arc gap is not provided as well.

Still also known in the prior art is an electric-arc device (U.S. Pat. No. 1,267,633) comprising two cylindric electrodes mounted in alignment and forming an arc gap therebetween and a means for stabilizing the arc position in the arc gap made as a cylindric coil which is arranged around the electrodes coaxially therewith in the plane passing through the middle of the arc normal to the axis of the electrodes. The coil confines the electric arc to the axis of the electrodes. The device further comprises a means for moving the electric arc over the surfaces of the electrodes, said means being at least three current conductive rods equally spaced around the electrodes and parallel to the axis thereof.

The disadvantage of the device is the substantial power consumption required to confine the electric arc to the axis of the electrodes. This results from the fact that a nonuniform magnetic field produced by the coil in the arc gap has a rather low average level of intensity and a low gradient of field intensity rise from the axis of the electrodes to their periphery. Hence, to provide an efficient stabilization of the electric arc position, a sufficiently high power consumption is required for energizing the coil. Thus, to keep a 50 A DC arc close to the axis of the electrodes 200 mm in diameter, a power supply with an output of no less than 5 kW is required for energizing the coil.

Also, in accordance with U.S. Pat. No. 1,267,633, a substantial power consumption is required to move the electric arc over the surfaces of the electrodes. This is associated with high losses of power in its delivery to current conducting rods.

SUMMARY OF THE INVENTION

It is an object of the present invention to provide an electric-arc device, wherein less power consumption is required to stabilize the electric arc position in the arc gap.

It is another object of the present invention to provide an electric-arc device, wherein a magnetic field is produced in the arc gap with a higher gradient of field intensity rise towards the periphery of the electrodes.

It is still another object of the present invention to provide an electric-arc device, wherein less power consumption is required to move the electric arc over the surfaces of the electrodes.

With these and other objects in view, there is provided an electric-arc device comprising two aligned cylindric electrodes separated by an arc gap and a means for stabilizing the position of an electric arc in the arc gap, said means including two cylindric coils embracing the electrodes and mounted in alignment with a distance therebetween no less than the value of the arc gap, the axis of the coils being parallel to the axis of the electrodes. The coils are connected to a power supply such that currents flowing therein are oppositely directed. The location of the coils with respect to a plane passing through the middle of the arc gap normal to the axis of the electrodes is limited by two extreme positions. In the first position the coils are symmetric about said plane, and in the second position one of the coils is in said plane and the other coil is displaced towards the negative electrode.

The two cylindric coils electrically connected in opposition and arranged in the aforementioned way provide in the zone of the arc gap a magnetic field with an increased average intensity and a more steep rise thereof in a radial direction from the axis of the coils. Such a field exhibits improved stabilization of the electric arc position, which makes it possible to reduce the power consumed in energizing the coils. Said limits of position of the coils with respect to the plane passing through the middle of the arc gap normal to the axis of the electrodes have been found by experiment.

With these and other objects in view, there is also provided an electric-arc device comprising two aligned cylindrical electrodes separated by an arc gap and a means for stabilizing the position of an electric arc in the arc gap, said means including at least two coils each of which is a rectangular loop bent round a cylindric surface to form a first and a second arcuate sides and two straight sides. The coils are mounted around the electrodes such that their first and second arcuate sides form two respective circumferences whose centers lie on a line parallel to the axis of the electrodes. The coils are connected to a power supply such that currents flowing along their first arcuate sides are directed in opposition to currents flowing along their second arcuate sides. The length of the straight side of each coil is no less than the value of the arc gap. The location of each coil with respect to a plane passing through the middle of the arc gap normal to the axis of the electrodes is limited by two extreme positions. In the first position the coil is symmetric about said plane, and in the second position the coil is displaced towards the negative electrode and one of its arcuate sides lies in said plane.

In this embodiment of the electric-arc device the arcuate sides of the rectangular coils form two cylindrical coils spaced apart at a distance equal to the length of the straight sides of the rectangular coils. Currents flowing along the arcuate sides of the rectangular coils in opposite directions produce a magnetic field of a similar configuration, that is with a more sharply defined minimum of intensity along the axis of the cylindric surface round which the coils are bent and with a higher average level of the intensity. Hence, both embodiments of the electric-arc device are equivalent designs as regards the improvement of the stability of the arc position in the arc gap. The second embodiment of the device as compared to the first one makes it possible to perform an additional function, that is to move the electric arc over the surfaces of the electrodes, the power consumed in this movement being also reduced as compared to the prior art device described in U.S. Pat. No. 1,267,633.

The aforementioned and other objects and advantages of the present invention will become more apparent from a detailed description of its preferred embodiments taken with reference to the accompanying drawings.

BRIEF DESCRIPTION OF THE ACCOMPANYING DRAWINGS

DESCRIPTION OF THE PREFERRED EMBODIMENTS

Figure 1:
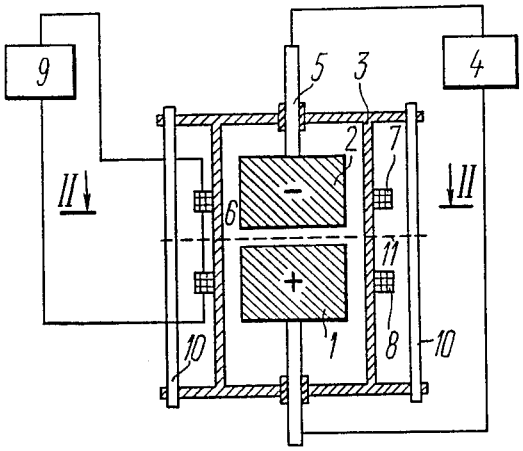
FIG. 1 shows an electric-arc device according to one of the embodiments of the invention.

An electric-arc device according to the invention comprising a positive electrode 1 (FIG. 1) and a negative electrode 2 mounted in alignment therewith, for example in a vacuum chamber 3 and connected to a DC power supply 4 via current leads 5. The end surfaces of the electrodes 1 and 2 form an arc gap 6 therebetween.

The device further comprises a means for stabilizing the position of an electric arc in the arc gap, formed by two similar coils 7 and 8 mounted around the electrodes 1 and 2, for example, coaxially therewith. In the general case, arrangement of the coils 7, 8 coaxially with the electrodes 1, 2 is not obligatory. If the electric arc should be kept not on the axis of the electrodes 1, 2, but in some other place of the arc gap 6, the axis of the coils 7, 8 must be displaced with respect to the axis of the electrodes 1, 2 by a corresponding distance.

The diameter of each of the coils 7, 8 is much larger than the thickness and height thereof. In this case, as far as the production of a nonuniform magnetic field is concerned, the coil is similar to a current loop.

The coils 7, 8 are connected to a DC or AC power supply 9 such that currents flowing therein are oppositely directed. FIG. 1 shows a series connection of the coils 7, 8, but it is also possible to connect them in parallel. Alternatively, each of the coils 7, 8 may be connected to an individual power supply. It is essential in connecting the coils to a power supply (supplies) that the direction of current in one of the coils be opposite to that in the other coil, since only in this case do the magnetic fields produced by the coils 7, 8 interact to create a resultant magnetic field which has the required configuration.

The coils 7, 8 are retained on the chamber 3 such as by friction or secured by any other suitable means.

A minimum distance between the coils 7 and 8 is equal to the value of the arc gap. This condition is necessary to provide location of the entire electric arc within the region of the confining field produced by the coils 7, 8. If the distance between the coils 7, 8 is less than the value of the arc gap 6, there may appear arc portions which are beyond the confining field, and thus an uncontrolled travel of the arc may be observed.

A maximum distance between the coils 7, 8 is defined by a requirement of producing a magnetic field which provides efficient confinement of the electric arc to a required point of the arc gap 6 with a reasonable power consumption.

To move the electric arc over the surfaces of the electrodes 1, 2, the device may include current conducting rods 10 (FIG. 2) similar to the rods used in the device in accordance with U.S. Pat. No. 1,267,633. The rods 10 are equally spaced around the electrodes 1, 2 parallel to the axis thereof. A power supply for energizing the rods 10 and a control unit providing a predetermined path of arc travel over the surfaces of the electrodes 1, 2 are not shown in FIG. 1 and 2 since they have no relation to the subject matter of the present invention.

The location of the coils 7 and 8 along the axis of the electrodes 1, 2 is also defined to provide in the zone of the arc gap 6 a magnetic field with fair confining properties. It has been found by experiment that this condition is fulfilled when the coils 7, 8 take any position between the following two extreme positions: in the first extreme position the coils 7, 8 are symmetric about a plane 11 passing through the middle of the arc gap 6 normal to the axis of the electrodes 1, 2, and in the second extreme position one of the coils, such as the coil 8, is in this plane 11 and the other coil 7 is displaced with respect to the coil 8 towards the negative electrode 2. The plane 11 is shown in FIG. 1 by a dotted line. In other words, one of the coils, such as the coil 8, is away from the plane 11 towards the positive electrode 1 at a distance lying in the range from 0 to $l/2$, where $l$ is the distance between the coils 7, 8, and the other coil 7 is away from the plane 11 towards the negative electrode 2 at a distance lying in the range from $l/2$ to $l$. With any other location of the coils 7, 8 with respect to said plane 11, the magnetic field formed by the coils 7, 8 loses its ability to confine the arc, and the arc travels over the surfaces of the electrodes 1, 2 at random. The authors of the present invention have found that the optimum location of the coils 7, 8 is the one in which the coil 8 is in the plane of the end surface of the positive electrode 1 and the distance between the coils 7, 8 is twice the arc gap 6. (The expression "the coil is in the plane . . . " used herein and below implies that arranged in this plane is the end surface of the coil facing the arc gap 6).

The parameters of the coils 7, 8 such as the diameter, number of turns, and current are chosen by calculations or by experiment according to the parameters of an electric arc, diameter of the electrodes 1 and 2, and value of the arc gap 6.

Figure 2:
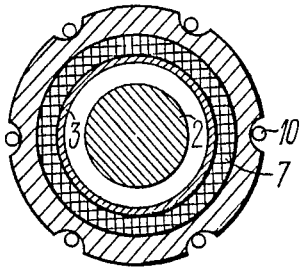
FIG. 2 shows a cross-sectional view along the line II—II of FIG. 1.
Figure 3:
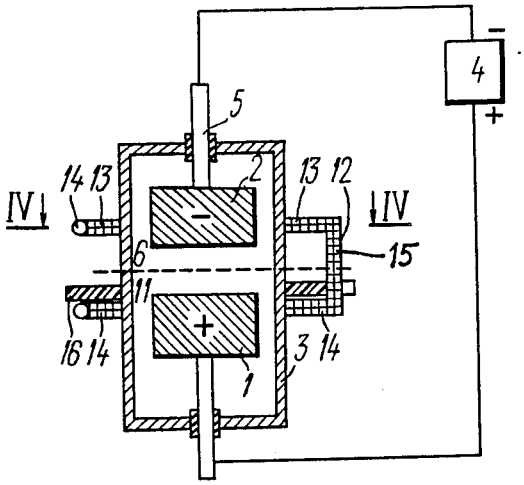
FIG. 3 shows an electric-arc device according to another embodiment of the invention.
Figure 4:
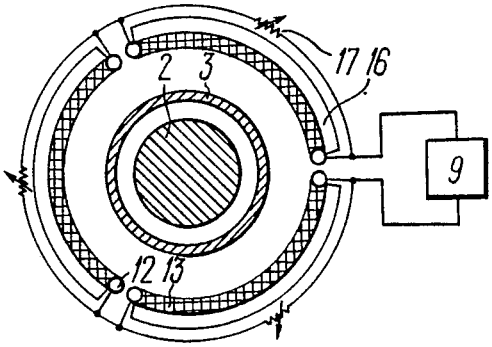
FIG. 4 shows a cross-sectional view along the line IV—IV of FIG. 3.

FIGS. 3 and 4 show another embodiment of the invention differing from the aforedescribed one in that the means for stabilizing the position of an electric arc in the arc gap comprises, for example, three identical coils 12 of a configuration differing from that of the coils 7, 8 shown in FIGS. 1 and 2. Each of the coils 12 is made as a rectangular loop bent round a cylindric surface such that the coil has two arcuate sides 13, 14 and two straight sides 15. The coils 12 are mounted around the chamber 3 in a support 16, their straight sides 15 being parallel to the axis of the electrodes 1, 2 and their arcuate sides 13, 14 forming two respective circumferences whose centers are on a line parallel to the axis of the electrodes 1, 2. In a specific example shown in FIGS. 3 and 4 the centers of the circumferences formed by the arcuate sides 13, 14 of the coils 12 lie on the axis of the electrodes 1, 2. The length of the straight sides 15 of each coil 12 is no less than the value of the arc gap 6, and the distance between the coils 12 should be as small as possible and preferably such that the adjacent straight sides 15 of the neighbouring coils 12 closely adjoin each other as shown in FIG. 4.

The coils 12 are connected to the power supply 9 and placed in series with each other such that currents flowing along their adjacent straight sides 15 (FIG. 3) are oppositely directed. In this case currents in the arcuate sides 13 or 14 lying in one plane flow in the same direction, and the direction of currents in the arcuate sides 13 is opposite to that in the arcuate sides 14. Other ways of connecting the coils 12 to the power supply 9 (FIG. 4) are also possible. For example, they may be connected with each other in parallel, or each of them may be energized by an individual power supply. The power supply 9 may be a DC or AC power supply.

Placed between the leads of each coil 12 are variable resistors 17. Instead of the resistors 17, it is possible to use any control circuit which provides variation of current in the coils 12 in accordance with a required manner of an electric arc travel. Such circuits are well known to those skilled in the art and, hence, not shown in FIGS. 3 and 4.

As in the first embodiment of the invention, the thickness of the coils 12 is at least an order of magnitude smaller than the radius of a cylindric surface around which these coils are bent and smaller than the length of their straight sides 15 (FIG. 3). In this case the coils 12 provide a magnetic field similar to that of current loops of the same configuration.

The location of the coils 12 along the axis of the electrodes 1, 2, as in the device shown in FIGS. 1 and 2, is limited by two extreme positions. In the first extreme position the coils 12 are symmetric about the plane 11 passing through the middle of the arc gap 6 normal to the axis of the electrodes 1, 2, and in the second extreme position the coils 12 are displaced towards the negative electrode, the arcuate sides 14 thereof lying in the plane 11. A preferable location of the coils 12 is one in which the arcuate sides 14 lie in the plane of the end of the positive electrode 1 and the length of the straight sides 15 is twice the value of the arc gap 6.

It is apparent that the embodiments of the device shown in FIGS. 1, 2 and FIGS. 3, 4 are equivalent solutions of problems of producing in the arc gap 6 a magnetic field which provides an efficient stabilization of the arc position in the arc gap 6. This field is produced in both cases by annular elements encircling the electrodes 1, 2, which are spaced apart along their axis and electrically connected in opposition such that currents flow therein in opposite directions. In the first embodiment of the invention shown in FIGS. 1 and 2 such annular elements are formed by the cylindric coils 7, 8, and in the second embodiment shown in FIGS. 3 and 4 one annular element is formed by the arcuate sides 13 of the coils 12 and the other annular element is formed by the arcuate sides 14. As compared to the first embodiment of the invention, the second embodiment makes it possible to perform an additional function, that is to move the arc in the zone of the arc gap 6. This function is provided by passing currents of different values through the coils 12.

If it is required to provide only stabilization of the electric arc position or stabilization of the arc position and arc displacement in a single direction, a minimum number of the coils 12 in the device shown in FIGS. 3 and 4 is equal to two. If it is required to provide arc displacement in any direction along with stabilization of the arc position, a minimum number of the coils 12 is equal to three.

Since the aforedescribed embodiments of the invention are equivalent, considerations relating to the coil parameters presented in the description of the device according to FIGS. 1 and 2 are also applicable to the device shown in FIGS. 3 and 4.

The electric-arc device operates as follows.

On turning on the power supply 4 (FIG. 1), the electrodes 1, 2 are energized, a voltage supplied being sufficient to provide an electric discharge in the arc gap 6. Simultaneously, the power supply 9 is turned on. As this takes place, an electric current flows through the coils 7, 8, being opposite.

Figure 5:
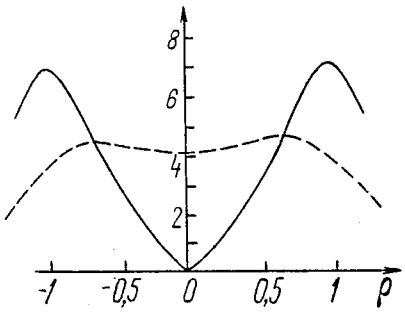
FIG. 5 shows plots of distribution of the modulus of a magnetic field intensity in the arc gap for the proposed and prior art devices.

Formed in the arc gap 6 is a nonuniform magnetic field characterized by a more sharply defined minimum of intensity on the axis of the coils 7, 8 as compared to a field produced by a single coil with equal power consumption. This is illustrated in FIG. 5 in which distribution of the modulus of a magnetic field intensity in the plane 11 normal to the axis of the coils 7, 8 and passing through the middle of the arc gap 6 in the device of FIG. 1 is shown by a solid line. The coils 7, 8 are spaced at a distance equal to the value of the arc gap 6, the value of the arc gap 6 being equal to the radius of the coils 7, 8. The values of the modulus $|H|$ of a magnetic field intensity and the distance $\rho$ from the axis of the coils 7, 8 are expressed in relative units. For comparison, distribution of the modulus of a magnetic field intensity produced by a single coil having the same parameters in a plane remote from the coil at a distance equal to half the arc gap is shown by a dotted line.

An electric arc exhibiting diamagnetic properties is disposed in the region of a minimum of a field intensity within the arc gap 6. As it does so, due to a higher gradient of a magnetic field intensity, a more stringent stabilization of an electic arc position in the arc gap 6 is achieved. If it is possible to retain the same field confining properties as in the device according to U.S. Pat. No. 1,267,633, the power consumption in producing this field is correspondingly reduced.

When currents of equal values flow in the coils 12 of the device shown in FIGS. 3, 4, magnetic fields produced by the currents flowing along the adjacent straight sides 15 of the neighboring coils 12 are mutually balanced out. In this case it is possible to provide only stabilization of an electric arc position along the axis of a cylinder formed by the coils 12, and the operation of the device is similar to that of the device shown in FIGS. 1 and 2. To displace the electric arc in the arc gap 6, the value of current in one or two coils 12 is varied by a respective resistor 17. For example, on reduction of current in any of the coils 12, the electric arc will approach this coil along the radius passing through the center thereof. By respectively varying currents flowing in the coils 12, it is possible to provide any required manner of an electric arc travel in the arc gap 6. In so doing, the power consumed in displacing the arc is reduced as compared to a similar power consumption in the device according to U.S. Pat. No. 1,267,633, since on variation of current values in the coils 12 the region of a minimum magnetic field intensity travels in the arc gap 6 and the arc stays in this region. Because stabilization of the arc position and arc displacement use the same elements, total power consumption in controlling the electric arc position is respectively reduced.

By comparing the embodiments of the device shown in FIGS, 1, 2 and FIGS. 3, 4, it can be said that the advantage of the embodiment according to FIGS. 3, 4 resides in that it does not require special elements for displacing the electric arc, whereby a total power consumption in controlling the arc is reduced. Besides, the construction of the device according to FIGS. 3, 4 is more convenient to service since it allows removal of the coils without dismantling of other elements of the device. At the same time, however in some fields of application of electric-arc devices, such as in melting of titanium in vacuum electric-arc furnaces, there is a danger of arc burning through a water-cooled wall of the chamber, which may result in an explosion. Taking this into consideration, the embodiment of a device according to FIGS. 3, 4 has a lower reliability of operation, since on failure of one of the coils 12 the arc is displaced and may touch the wall of the vacuum chamber.

Given below are numerical characteristics of specific embodiments of an electric-arc device according to the invention.

An electric-arc device according to FIGS. 1, 2
Electrode diameter: 200 mm
Electrode material: titanium
Arc gap value: 50 mm
Arc diameter: 15 mm
Arc current: 50 A DC
Coil diameter: 250 mm
Coil thickness and height: 25 mm
Number of turns in each coil: 500
Distance between coils: 100 mm
One coil lies in the plane of the end of the positive electrode
Current in each coil: 5 A DC
Power consumed by the coils: 0.5 kW
Power consumed by the coil of similar parameters in a prior art device (U.S. Pat. No. 1,267,633): 5 kW An electric-arc device according to FIGS. 3, 4
Electrode diameter: 200 mm
Electrode material; titanium
Arc gap value: 50 mm
Arc diameter: 15 mm
Arc current: 50 A DC
Number of coils: 3
Coil thickness: 25 mm
Number of turns in each coil: 500
Radius of coil arcuate sides: 125 mm
Length of coil straight sides: 100 mm
Current in each coil: 5 A DC
One of the arcuate sides of each coil lies in the plane of the end of the positive electrode.
Power consumed by the coil for stabilizing the position and displacing the electric arc: 1 kW
Power consumed for stabilizing the position and displacing the electric arc in a prior art device (U.S. Pat. No. 1,267,633): 10 kw As is seen from the above data, the proposed device provides a tenfold reduction of power consumption in controlling the electric arc position.

What is claimed is:

1. An electric-arc device comprising a positive cylindric electrode and a negative cylindric electrode mounted in alignment with and defining an arc gap therebetween; and means for stabilizing the position of an electric arc in said arc gap including at least two coils each of which is made as a rectangular loop bent round a cylindrical surface and having a first arcuate side and a second arcuate side and two straight sides, and at least one power supply for energizing said coils, said coils being mounted around said electrodes such that said first and second arcuate sides thereof form two respective circumferences whose centers lie on a line parallel to the axis of said electrodes, the length of each of said straight sides of each of said coils being no less than the length of said arc gap, said coils being connected to said power supply such that the direction of currents flowing along said first arcuate sides of said coils is opposite to that of currents flowing along said second arcuate sides of said coils, the location of each of said coils with respect to a plane passing through the middle of said arc gap normal to the axis of said electrodes being limited by two extreme positions, in the first one of said extreme positions said coil being symmetric about said plane, and in the second one of said extreme positions said coil being displaced towards said negative electrode and one of said arcuate sides of said coil lying in said plane.

* * * * *